US005423138A

United States Patent [19]

Livesay et al.

[11] Patent Number: 5,423,138

[45] Date of Patent: Jun. 13, 1995

[54] TIP TO ADAPTER INTERFACE

[75] Inventors: Richard E. Livesay, Peoria; Nate G. Rozenboom, Metamora, both of Ill.

[73] Assignee: Caterpillar, Inc., Peoria, Ill.

[21] Appl. No.: 223,249

[22] Filed: Apr. 4, 1994

[51] Int. Cl.[6] ..... F02F 9/28

[52] U.S. Cl. ..... 37/456; 37/452; 37/455; 172/713; 299/90

[58] Field of Search ..... 37/449, 450, 451, 452, 37/453, 454, 455, 456, 458, 459; 172/713, 719, 701.3, 772, 772.5; 299/90, 91, 92

[56] References Cited

U.S. PATENT DOCUMENTS

| | | | |
|---|---|---|---|
| 1,205,969 | 11/1916 | Brinton . | |
| 1,808,311 | 6/1931 | Madonna . | |
| 2,312,802 | 3/1943 | Crawford | 37/142 |
| 2,689,419 | 9/1954 | Daniel et al. | 37/456 |
| 2,919,506 | 1/1960 | Larsen | 37/142 |
| 2,921,391 | 1/1960 | Opsahl | 37/456 X |
| 2,934,842 | 5/1960 | Buskirk | 37/456 |
| 3,021,627 | 2/1962 | Johns | 37/142 |
| 3,079,710 | 3/1963 | Larsen | 37/142 |
| 3,196,956 | 7/1965 | Ratkowski | 172/713 |
| 3,410,010 | 11/1968 | Ratkowski | 37/454 |
| 3,463,521 | 8/1969 | Helton | 287/100 |
| 3,623,247 | 1/1970 | Stepe | 37/455 |
| 3,624,827 | 11/1970 | Liess et al. | 37/456 X |
| 3,643,357 | 2/1972 | Benning et al. | 37/449 X |
| 3,774,324 | 11/1973 | Lafond | 37/142 |
| 3,839,805 | 10/1974 | Stepe | 37/454 |
| 3,982,339 | 9/1976 | Nilsson | 37/455 X |
| 4,182,058 | 1/1980 | Poncin | 37/142 |
| 4,326,348 | 4/1982 | Emrich | 37/142 R |
| 4,335,532 | 6/1982 | Hahn et al. | 37/142 R |
| 4,357,765 | 11/1982 | Seykora | 37/455 |
| 4,414,764 | 11/1983 | Johansson et al. | 37/450 |
| 4,761,900 | 8/1988 | Emrich | 37/142 |
| 4,872,274 | 10/1989 | Giersch et al. | 37/450 X |
| 4,965,945 | 10/1990 | Emrich | 37/456 |
| 5,152,088 | 10/1992 | Hahn | 37/458 |
| 5,272,824 | 12/1993 | Cornelius | 37/455 X |
| 5,325,615 | 7/1994 | Hutchins et al. | 172/713 X |

FOREIGN PATENT DOCUMENTS 60-38784 11/1985 Japan .

*Primary Examiner*—Dennis L. Taylor
*Assistant Examiner*—Robert Pezzuto
*Attorney, Agent, or Firm*—J. W. Burrows

[57] ABSTRACT

Tooth assemblies having a tip attached to an adapter by a retaining mechanism is normally utilized in order to readily replace the tip which is a high wear element. It is advantageous to have a tip that due to its interface with the adapter allows effective transfer of forces being subjected to the tip directly to the adapter without creating undesired resultant forces trying to force the tip from the adapter. In the subject arrangement, a tip has a cavity with a load bearing bottom surface at the bottom of the cavity and a pair of parallel spaced apart load bearing surfaces adjacent thereto. The tip also has an ear extending from one of the side walls thereof, a longitudinally extending groove defined therein, and a pin receiving opening 56 defined therein that extends through a top wall, the one side wall and a bottom wall of the tip and intersects the longitudinally extending groove. The adapter has a forward end which mates with the load bearing bottom surface and the pair of parallel spaced apart load bearing surfaces of the tip and has a raised lug on one side thereof which is disposed, upon assembly, in the longitudinally extending groove. A pin is forced through a pin receiving opening and contacts the raised lug to secure the tip to the adapter.

29 Claims, 10 Drawing Sheets

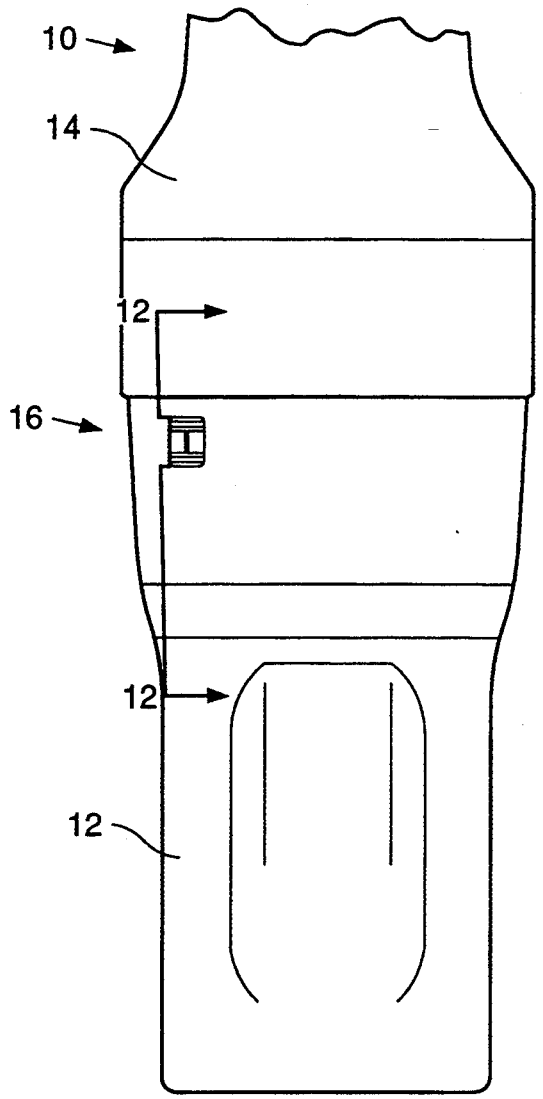
Fig. 11.
Fig. 12.
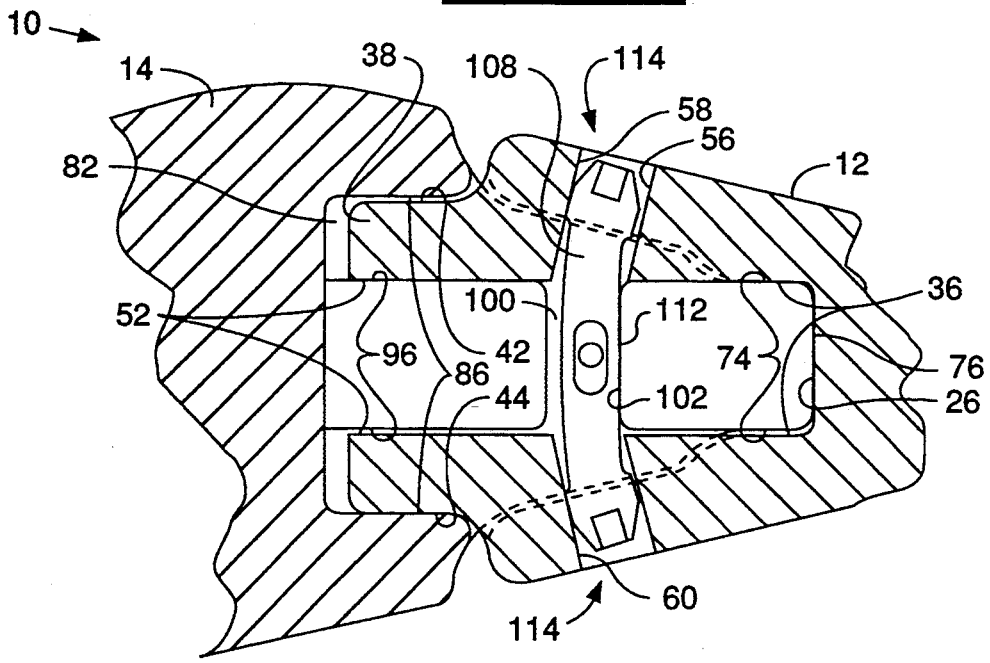

TIP TO ADAPTER INTERFACE

TECHNICAL FIELD

This invention relates generally to the cutting edge of an earthworking implement and more particularly to the interface of a tip to an adapter for use on the cutting edge.

BACKGROUND ART

Tooth assemblies normally include an adapter which is secured to an earthmoving implement and a tip which is mounted on the adapter and secured thereto by a retaining mechanism. In most cases, the tip has a cavity defined by converging top and bottom walls and generally parallel side walls interconnected between the top and bottom walls with aligned holes in both extending through the center of the tip and adapter which receives a pin or some other form of locking mechanism. During use, loads that are applied to the forward end of the tip is transferred to the adapter through the top and bottom walls that are in contact with mating surfaces on the adapter. This force being exerted on the forward end of the tip is partially transferred to the adapter with a resultant portion of that force acting to cause the converging top and bottom walls to attempt to slide off the mating surface of the adapter. This force must be resisted by the retaining mechanism. Consequently, in many applications, this is the reason that retaining mechanisms have broken or otherwise failed, thus, allowing the tip to disengage from the adapter. Other tooth assemblies have utilized generally flat surfaces in the bottom of a cavity that mate with generally flat surfaces on the adapter acting in cooperation with extensions on the tip which mate in corresponding recesses on the adapter in order to better transfer the loads from the tip directly to the adapter. In these arrangements, aligned holes are normally defined in the tip and adapter through the center thereof for receipt of the retaining mechanism. In still other tooth assemblies, extensions of the sidewall members are utilized in conjunction with corresponding ears on the adapter to receive a locking pin to secure the tip to the adapter. In these arrangements, the loads being applied to the forward end of the tip is being transferred to the adapter totally within the cavity of the tip. Likewise, other arrangements are known wherein the pin retaining mechanism is disposed in the tip and adapter between the sidewall of the tip and the nose of the adapter. As with previous noted tooth assemblies, all loads being subjected to the forward end of the tip is being transferred to the adapter totally within the cavity of the tip.

The present invention is directed to overcoming one or more of the problems as set forth above.

DISCLOSURE OF THE INVENTION

In one aspect of the present invention, a tip is provided and adapted for use on an earthworking implement. The tip includes a forward portion operative to engage the material being worked and a rearward mounting portion operative to be secured to the implement. The rearward portion of the tip has a cavity therein defined by a top wall, a bottom wall and a pair of side walls and is located adjacent the rearward end of the tip. An ear extends rearwardly from one of the side walls and has a longitudinally extending groove defined in the ear and the one side wall and is located on the side thereof adjacent the cavity. A pin receiving opening is defined in the tip and extends through the top wall of the one side wall, the bottom wall and intersects the longitudinally extending groove in the one side wall.

In another aspect of the present invention, an adapter is provided for use on an earthworking implement and is operative to receive the tip thereon. The adapter includes an implement mounting portion and a nose portion that is operative to receive a tip thereon. The adapter has a forward end with a pair of parallel spaced apart transverse surfaces and a generally flat end surface that is disposed between the pair of spaced apart transfer surfaces. The tip also includes top and bottom surfaces extending rearwardly at an angle from the respective ones of the spaced apart transfer surfaces and has a pair of raised lugs disposed on the nose portion. The pair of raised lugs is separated by the top and bottom surfaces.

The present invention provides a tip having an ear extending rearwardly from one of the side walls with a longitudinally extending groove defined in the ear and the one side wall on the side thereof adjacent the cavity. The pin receiving opening is defined in the tip and extends through the top wall, the one side wall, the bottom wall and intersects the longitudinally extending groove in the one side wall in order to provide an opening for receipt of a retaining mechanism. This arrangement does not weaken the tip while at the same time provides positive load transfer of the forces being applied to the forward end of the tip directly to the adapter through both the cavity and the rearwardly extending ear.

BRIEF DESCRIPTION OF THE DRAWINGS

FIG. 11 is a top view of the elements of FIG. 1 in their assembled condition;

FIG. 12 is a partial cross-sectional view of the assembly of FIG. 11 taken along the line 12—12;

BEST MODE FOR CARRYING OUT THE INVENTION

Figure 1:
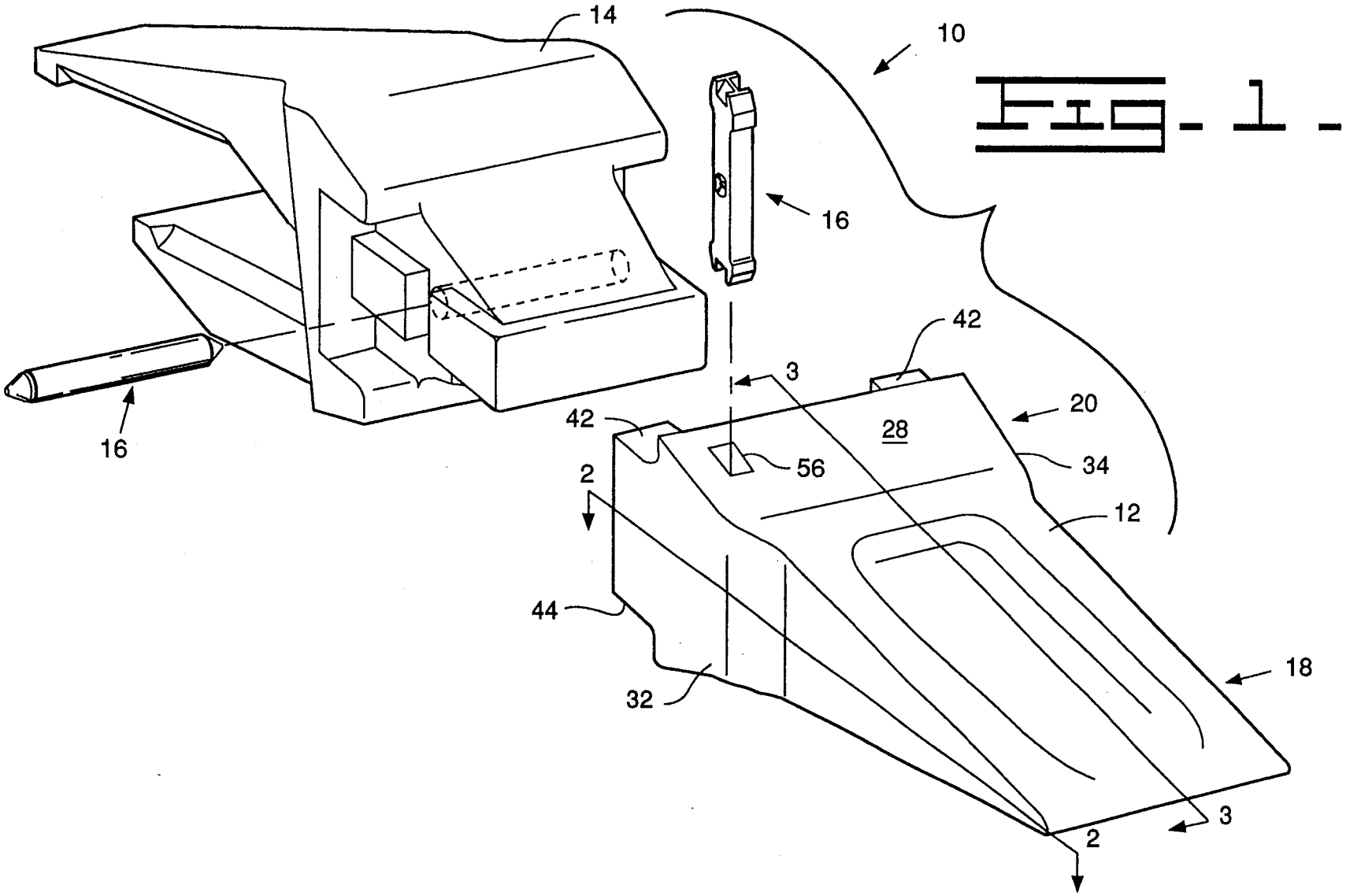
FIG. 1 is a diagrammatic representation of a tooth assembly illustrating all elements in their unassembled condition.
Figure 2:
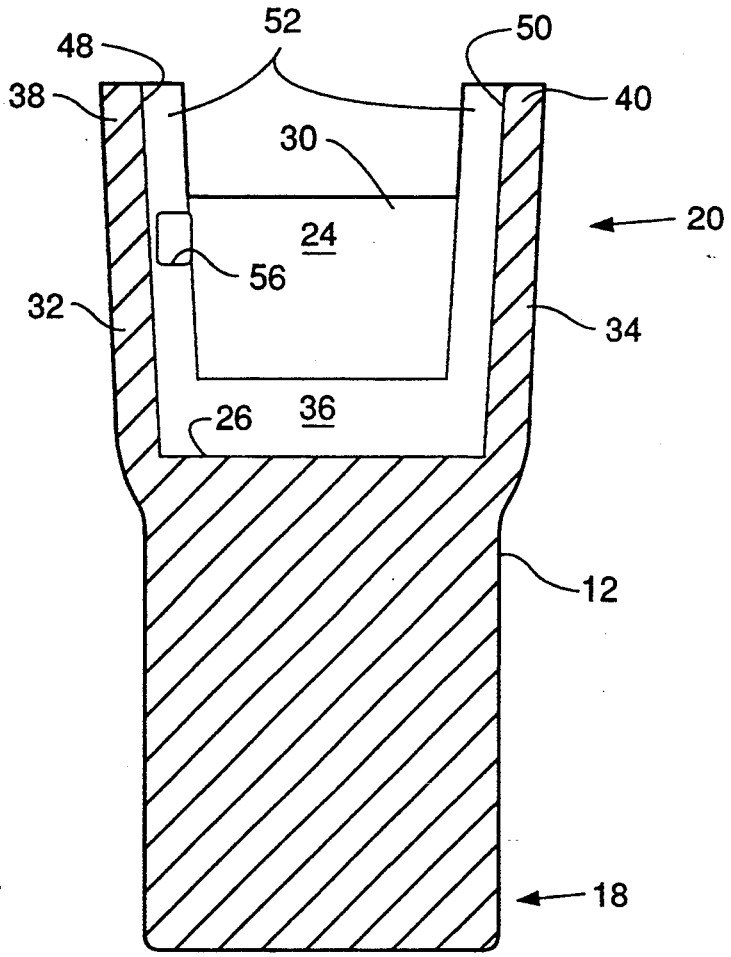
FIG. 2 is a sectional view of the tip of FIG. 1 taken along the line 2—2 of FIG. 1.
Figure 3:
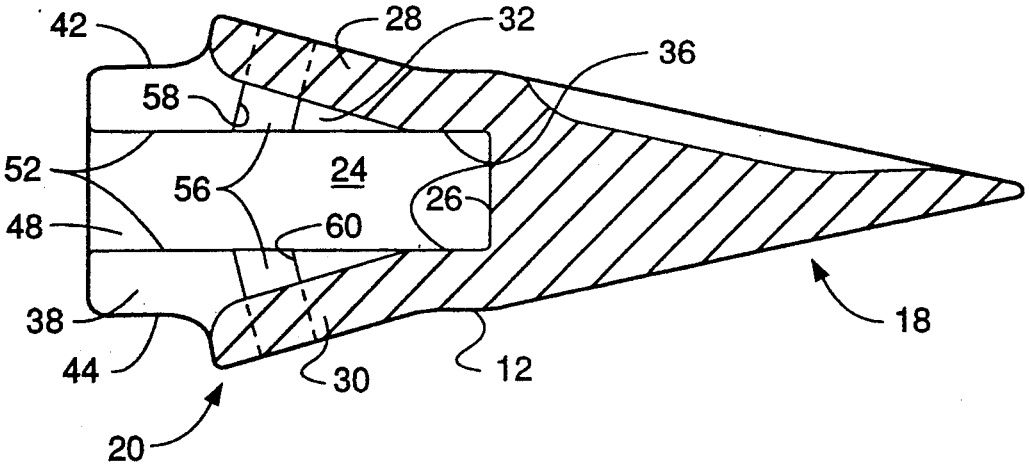
FIG. 3 is a cross-sectional view of the tip of FIG. 1 taken along the line 3—3 of FIG. 1.

Referring to the drawings and more particularly to FIGS. 1, 2 and 3, a tooth assembly 10 is illustrated and adapted for mounting to an earthworking implement (not shown). The tooth assembly 10 includes a tip 12, an adapter 14 and a retention mechanism 16. The tip 12 has a forward end portion 18 operative to engage the material being worked and a rearward mounting portion 20 operative to connect the tip 12 to the adapter 14.

A cavity 24 is defined in the rearward mounting portion 20 and extends from the rearward end of the tip 12 and terminates at a load bearing bottom surface 26. The cavity 24 is defined by a top wall 28, a bottom wall 30 and a pair of side walls 32,34. The top and bottom walls 28,30 are angled relative to each other to form an acute angle with the apex thereof being located generally in the forward portion. A pair of parallel spaced apart load bearing surfaces 36 are disposed in the cavity between the pair of sidewalls 32,34 and adjacent the load bearing bottom surface 26.

An ear 38 extends from the one side wall 32 while another ear 40 extends from the other side wall 34. Each of the rearwardly extending ears 38,40 has top and bottom load bearing surfaces 42,44. A longitudinally extending groove 48 is defined in the one ear 38 and extends into the one side wall 32 and on the side thereof adjacent the cavity 24. Another longitudinally extending groove 50 is defined in the other ear 40 and extends from the other side wall 34 and, likewise, extends into the other side wall 34 and on the side thereof adjacent the cavity 24. Each of the longitudinally extending grooves 48,50 are rectangular in cross-section and extends to the bottom of the cavity 24 and blends with the pair of spaced apart load bearing surfaces 36. Likewise, each of the longitudinally extending grooves 48,50 has vertically opposed load bearing surfaces 52.

A pin receiving opening 56 is defined in the tip 12 and includes a top portion 58 and a bottom portion 60. The pin receiving opening 56 extends through the top wall 28, the one side wall 32, the bottom wall 30 and intersects the longitudinally extending groove 48. The pin receiving opening 56 of the subject embodiment is rectangular in cross section, however, it is recognized that it could have various cross-sectional shapes without departing from the essence of the invention. The top portion 58 of the pin receiving opening is perpendicular to the top wall 28 and the bottom portion 60 is perpendicular to the bottom wall 30.

Figure 4:
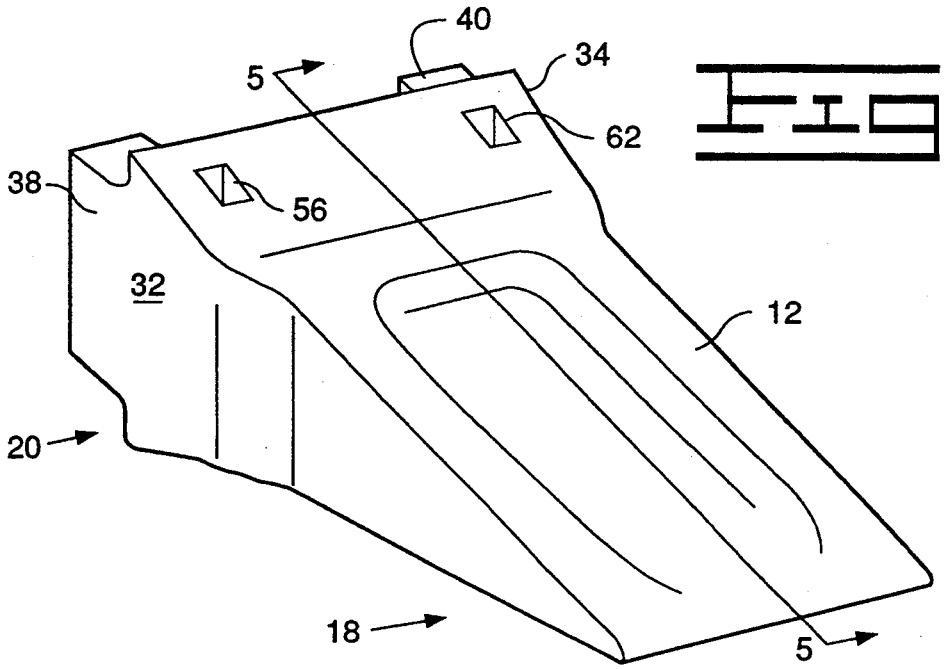
FIG. 4 is an isometric view of an alternate embodiment of the tip illustrated in FIG. 1.
Figure 5:
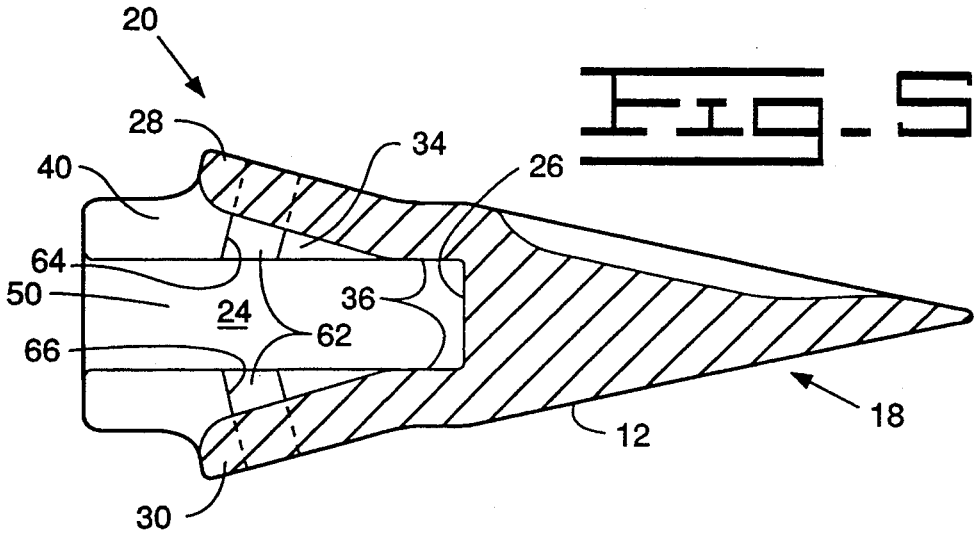
FIG. 5 is a cross-sectional view of the tip of FIG. 4 taken along the line 5—5.

Referring to FIGS. 4 and 5, another embodiment of the tip 12 is illustrated. All like elements have like element numbers. The tip 12 of FIGS. 4 and 5 is very similar to the tip 12 of the previous figures. The major difference of the tip illustrated in FIGS. 4 and 5 is that the tip 12 includes another pin receiving opening 62. The pin receiving opening 62 is likewise divided into top and bottom portions 64,66. As illustrated in FIG. 5, the tip 12 of the subject embodiment includes the other ear 40 extending from the other side wall 34, the longitudinally extending groove 50, the top wall 28, and the bottom wall 30. The other pin receiving opening 62 extends through the top wall 28, the other sidewall 34, the bottom wall 30 and intersects the other longitudinally extending groove 50. The top portion 64 of the opening 62 is perpendicular with the top wall 28 and the bottom portion 68 of the opening 62 is perpendicular to the bottom wall 30. Both the top portion 64 and the bottom portion 66 intersect the longitudinally extending groove 50.

Figure 6:
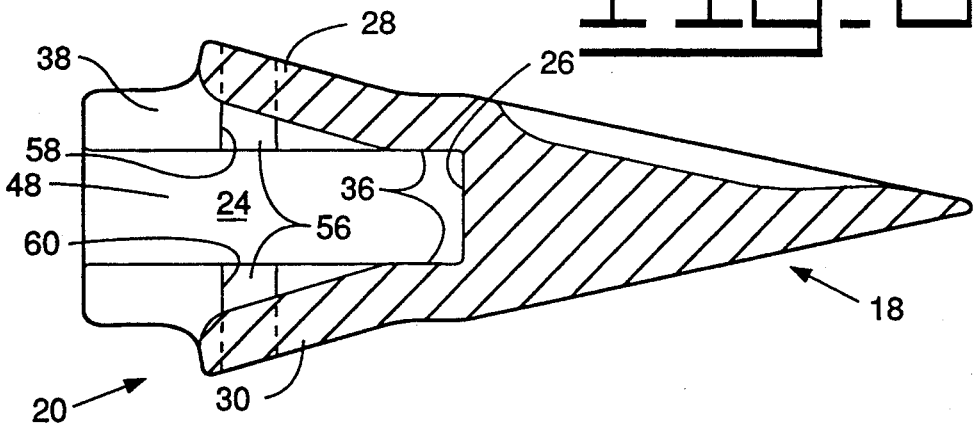
FIG. 6 is a cross-sectional view of an alternate embodiment of either of the tips illustrated in FIGS. 1 and 4.

Referring to FIG. 6, another embodiment of the tip 12 is illustrated. Like references have like reference numerals. The only difference illustrated in FIG. 6 is that the top portion 58 and the bottom portion 60 of the pin receiving opening 56 are both perpendicular to the longitudinally extending groove 48. The top portion 64 and bottom portion 66 of the pin receiving opening 62 illustrated in FIGS. 4 and 5 could likewise be perpendicular to the other longitudinally extending groove 50 without departing from the essence of the invention.

Figure 7:
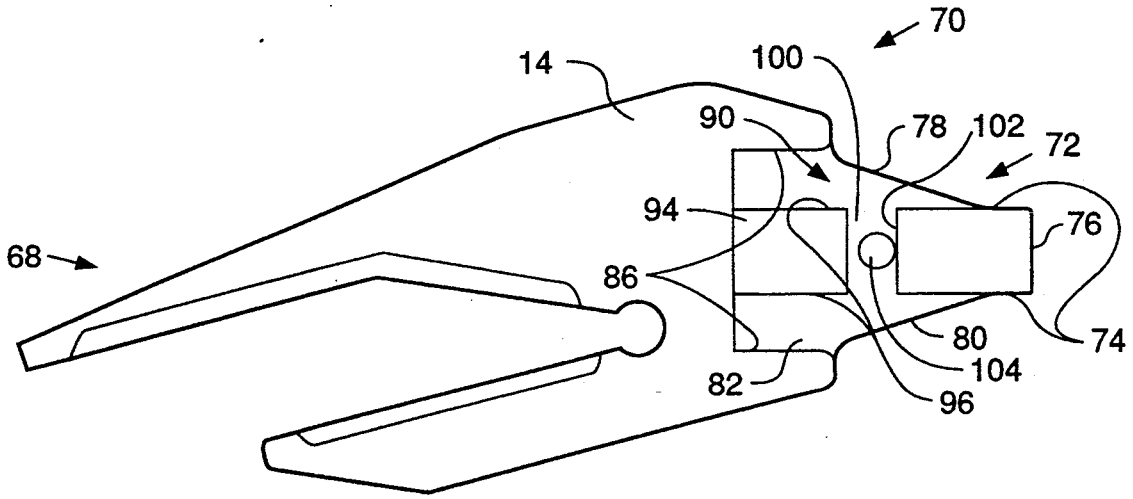
FIG. 7 is a side view of the adapter illustrated in FIG. 1.
Figure 8:
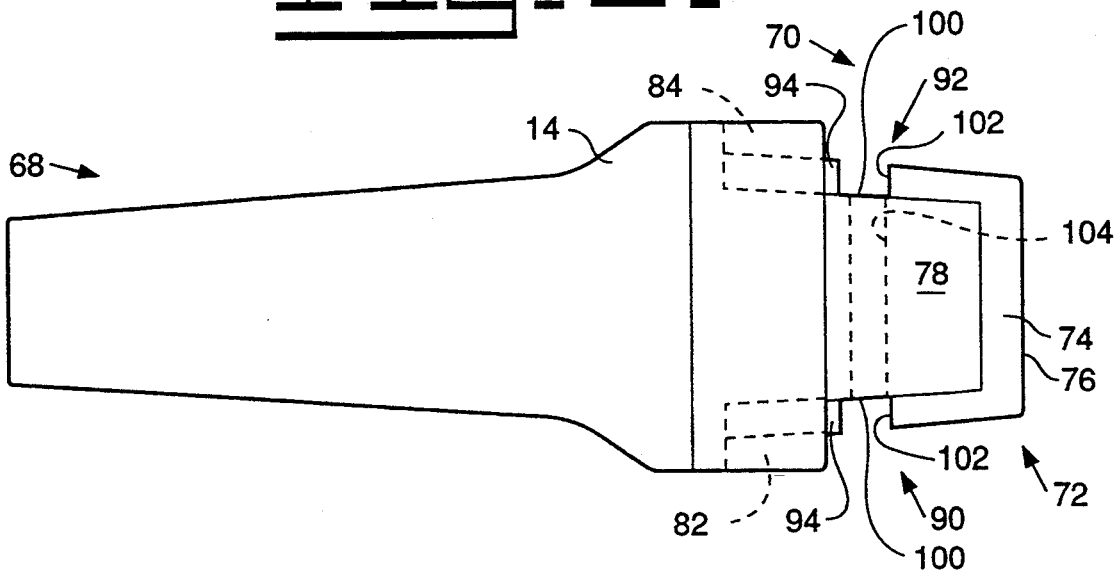
FIG. 8 is a top view of the adapter illustrated in FIG. 7.

Referring to FIGS. 7 and 8, the adapter 14 has a implement mounting portion 68 and a nose portion 70. The nose portion 70 includes a forward end 72 having a pair of parallel spaced apart transverse surfaces 74 interconnected by a generally flat end surface 76. The nose portion 70 also includes top and bottom surfaces 78,80 that extend at an angle from the spaced apart transverse surfaces 74. A pair of recesses 82,84 are defined in the nose portion 70 of the adapter 14 and located on each side of the adapter 14 spaced rearwardly from the generally flat end surface 76. Each of the recesses 82,84 has upper and lower load bearing surfaces 86.

A pair of raised lugs 90,92 are disposed on the nose portion 70 on opposite sides thereof and separated by the top and bottom surfaces 78,80. Each of the raised lugs 90,92 extend rearwardly from the spaced apart transverse surfaces 74. A portion 94 of each of the raised lugs 90,92 is disposed in the respective recesses 82,84 and has upper and lower load transferring surfaces 96.

A vertically oriented slot 100 is defined in each of the raised lugs 90,92 and located between the spaced apart transverse surfaces 74 and the pair of recesses 82,84. Each of the vertically oriented slots 100 has a pin contacting surface 102 disposed thereon on the surface thereof nearest the pair of parallel spaced apart transverse surfaces 74.

A transverse opening 104 is defined in the nose portion 70 and extends therethrough between the vertically oriented slots 100.

Figure 9:
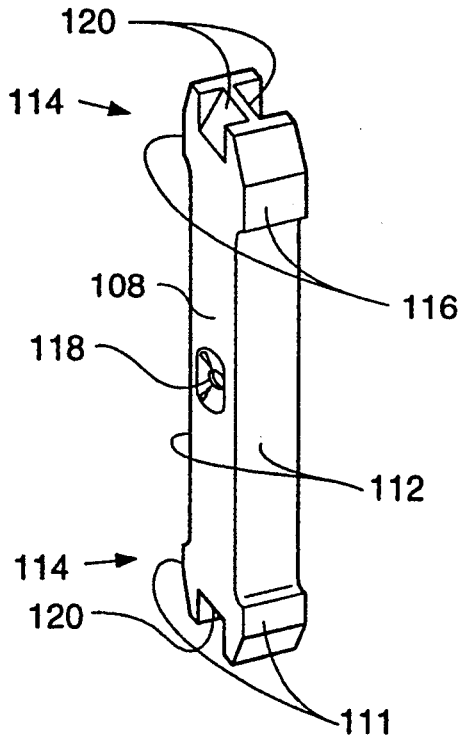
FIG. 9 is a portion of a retaining mechanism used in the subject invention.
Figure 10:
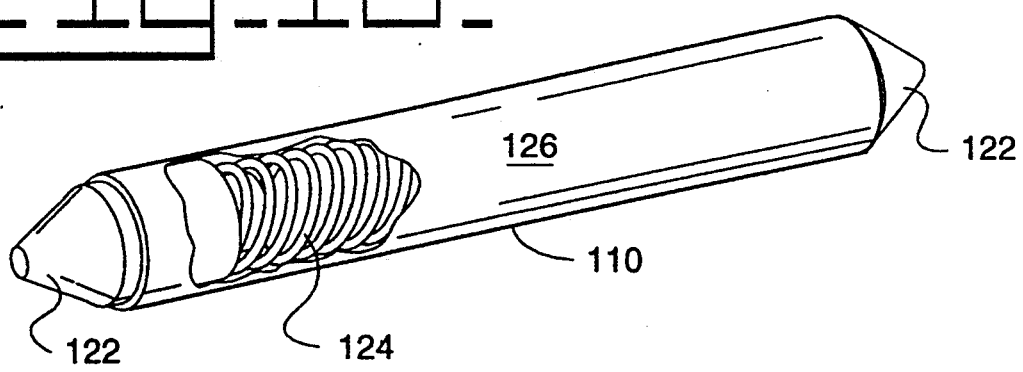
FIG. 10 is another portion of the retaining mechanism used in the subject invention.

Referring to FIGS. 9 and 10, the retention mechanism 16 is illustrated and includes a pin 108 and a biasing member 110. The pin 108 is generally rectangular in cross section and has side surfaces 112 adapted, when installed, for contacting the pin contacting surface 102 of the adapter 14. It is recognized that when installed, only one of the side surfaces 112 is in contact with the pin contacting surface 102. However, it is recognized that the subject pin 108 can be oriented such that either of the side surfaces 112 could be in contact with the pin contacting surface 102. The pin 108 also has end portions 114 each having force transferring surfaces 116 which are operative to engage mating surfaces on the pin receiving opening 56 of the tip 12. A recess 118 is defined on each of the other side surfaces of the pin 108 generally midway along the length thereof and operative to receive the ends of the biasing member 110. Angled slots 120 are defined in each of the end portions 114 between each of the other side surfaces and the ends thereof and operative to contact and depress the biasing member 110 during the assembly of the pin 108.

The biasing member 110 includes end members 122 disposed on each end thereof with a spring 124 attached therebetween. The spring 124 and at least a portion of each end member 122 are encased in a rubber sleeve 126. It is recognized that the rubber sleeve 126 could be molded in place or formed in various other ways without departing from the essence of the invention.

Referring to FIGS. 11 and 12, the tip 12, the adapter 14, and the retention mechanism 16 are illustrated in their assembled positions. FIG. 12 more clearly illustrates the interface between the tip 12, the adapter 14 and the retaining mechanism 16 and clearly illustrates how the pin 108 functions to retain the tip 12 on the adapter 14. As illustrated, the ear 38 of the tip 12 is received in the recess 82 of the adapter 14 and the pair of parallel spaced apart load bearing surfaces 36 on the tip 12 are disposed in mating contact with the pair of parallel spaced apart transverse surfaces 74 on the adapter 14. Likewise, the top and bottom load bearing surfaces 42 of the ear 38 are in position for load bearing contact with the respective upper and lower load bearing surfaces 86 within the recess 82. In addition, the vertically opposed load bearing surfaces 52 in the longitudinally extending groove 48 are in position for load bearing contact with the respective upper and lower load transferring surfaces 96 on the raised lug 90.

The pin 108 is disposed in the pin receiving opening 56 and forces the tip 12 to a position such that the load bearing bottom surface 26 of the tip 12 is in intimate contact with the generally flat end surface 76 of the nose portion 70. As noted from the illustration, the pin 108 is forced to flex when it is assembled. As illustrated, the side surface 112 of the pin 108 is in intimate contact with the pin contacting surface 102 of the vertically oriented slot 100 while the force transferring surfaces 116 of each of the end portions 114 of the pin 108 is in intimate contact with surfaces in the respective top portion 58 and bottom portion 60 of the pin receiving opening 56.

Figure 13:
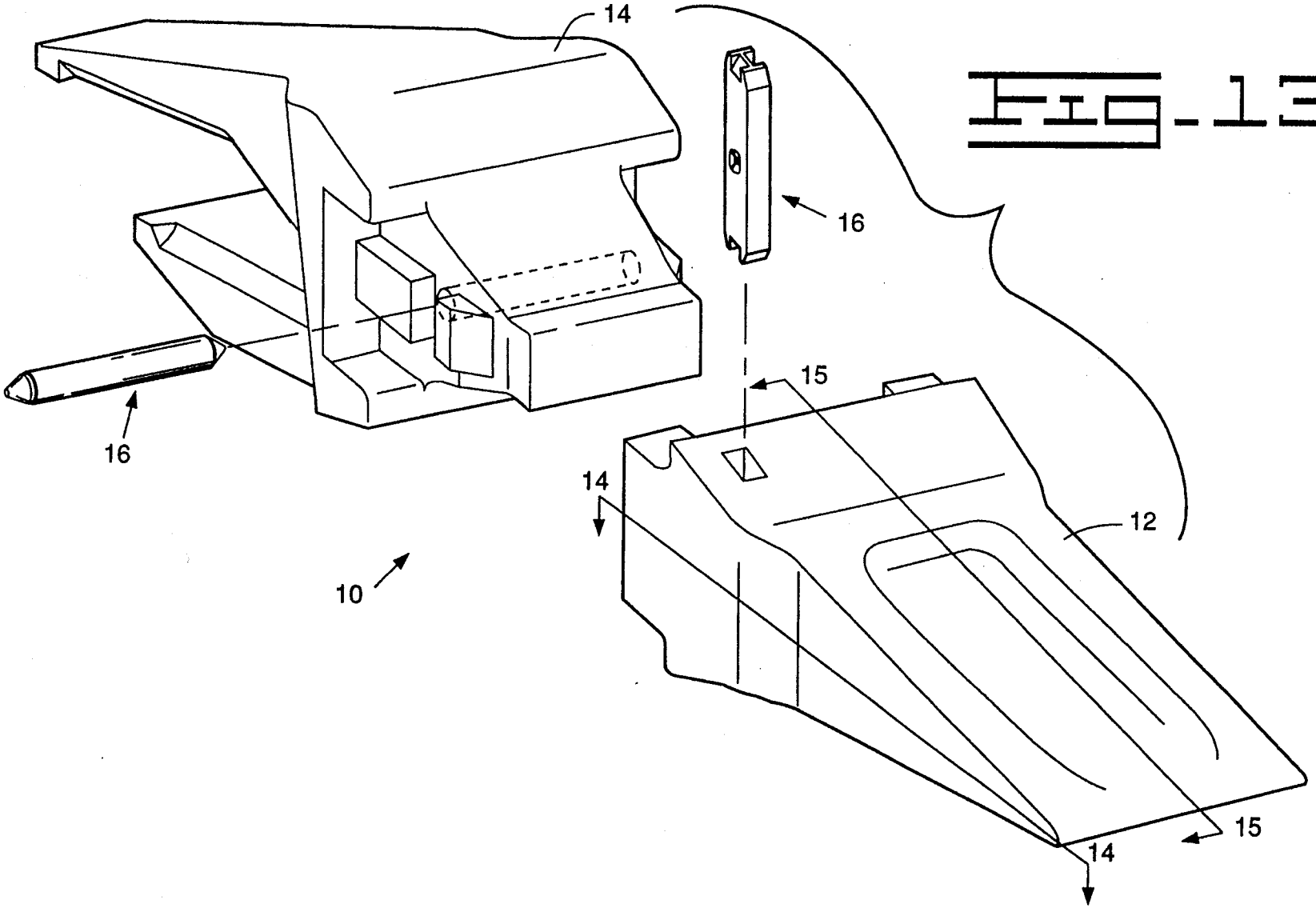
FIG. 13 is a diagrammatic representation of another embodiment of the tooth assembly illustrating all elements in their unassembled condition.
Figure 14:
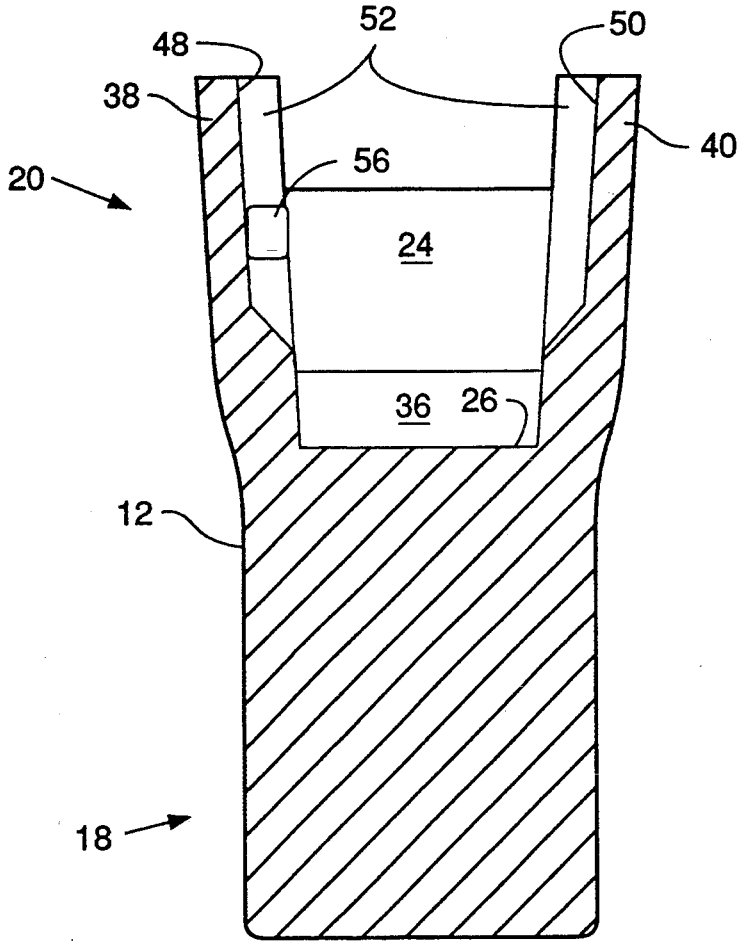
FIG. 14 is a sectional view of the tip illustrated in FIG. 13 taken along the line 14—14.
Figure 15:
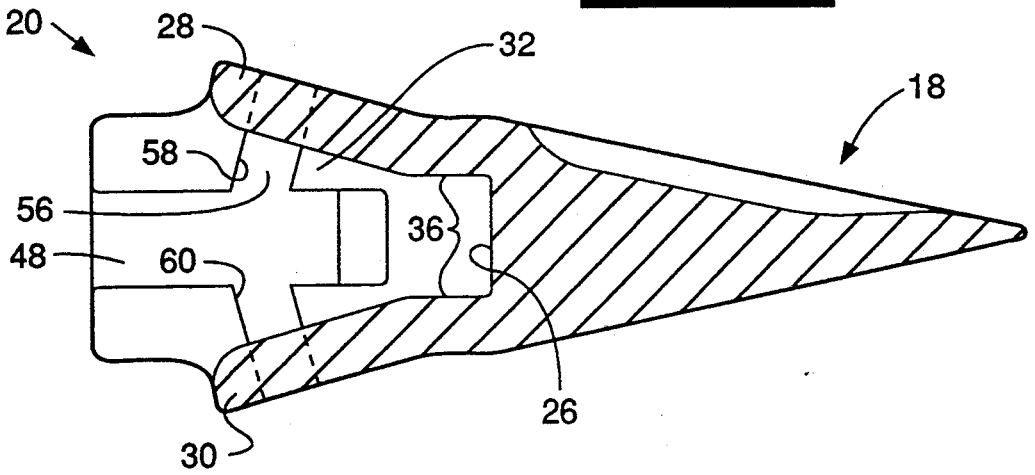
FIG. 15 is a cross-sectional view of the illustrated in FIG. 13 taken along the line 15—15.

Referring to FIGS. 13–18, another embodiment of the subject tooth assembly 10 is illustrated. Like elements have like element numbers. As illustrated in FIG. 13, the subject embodiment includes the tip 12, the adapter 14 and the retention mechanism 16. As more clearly identified in FIGS. 14 and 15, the only difference in the tip 12 of the subject embodiment is that the longitudinally extending grooves 48,50 terminate short of the load bearing bottom surface of the cavity 24. Additionally, as illustrated in FIG. 14, the pin receiving opening 56 has a width generally equal to the transverse width of the longitudinally extending groove 48. All other elements of the subject embodiment are the same as that described with respect to the previous embodiment.

Figure 16:
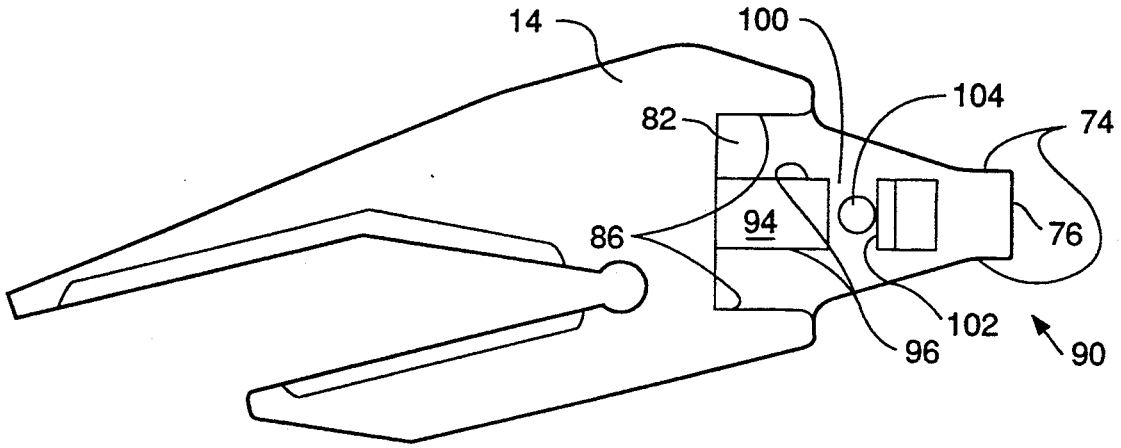
FIG. 16 is a side view of the adapter illustrated in FIG. 13.
Figure 17:
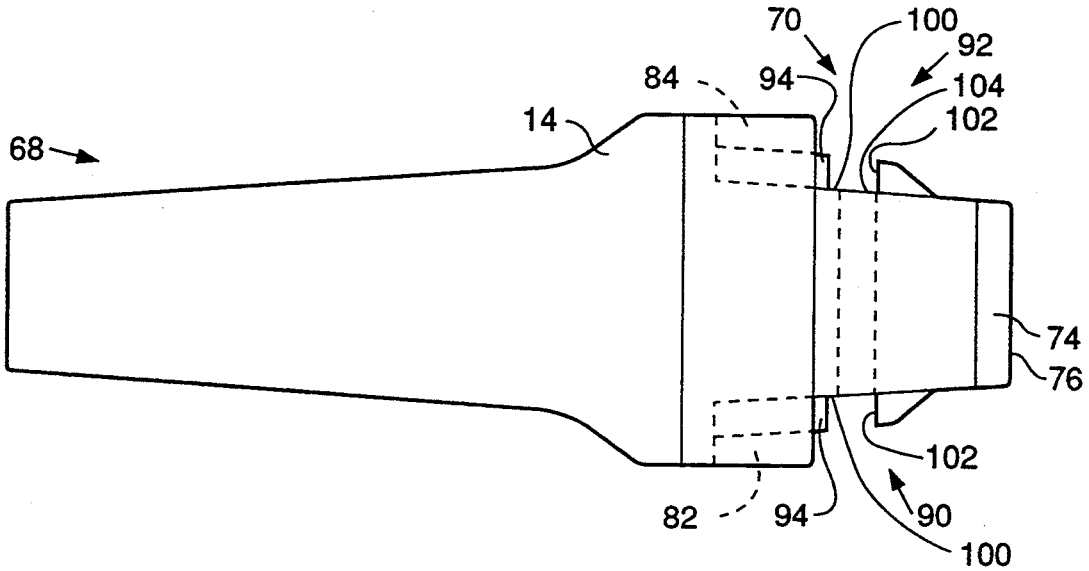
FIG. 17 is a top view of the adapter illustrated in FIG. 16.

Referring to FIGS. 16 and 17, the only difference between the adapter 14 of the subject embodiment as compared to the adapter 14 of the previous embodiment is that the pair of raised lugs 90,92 do not extend from the pair of parallel spaced apart transverse surfaces 74 but start at a point spaced rearwardly therefrom. All remaining elements of the adapter 14 are the same as that set forth with the previous embodiment.

Figure 18:
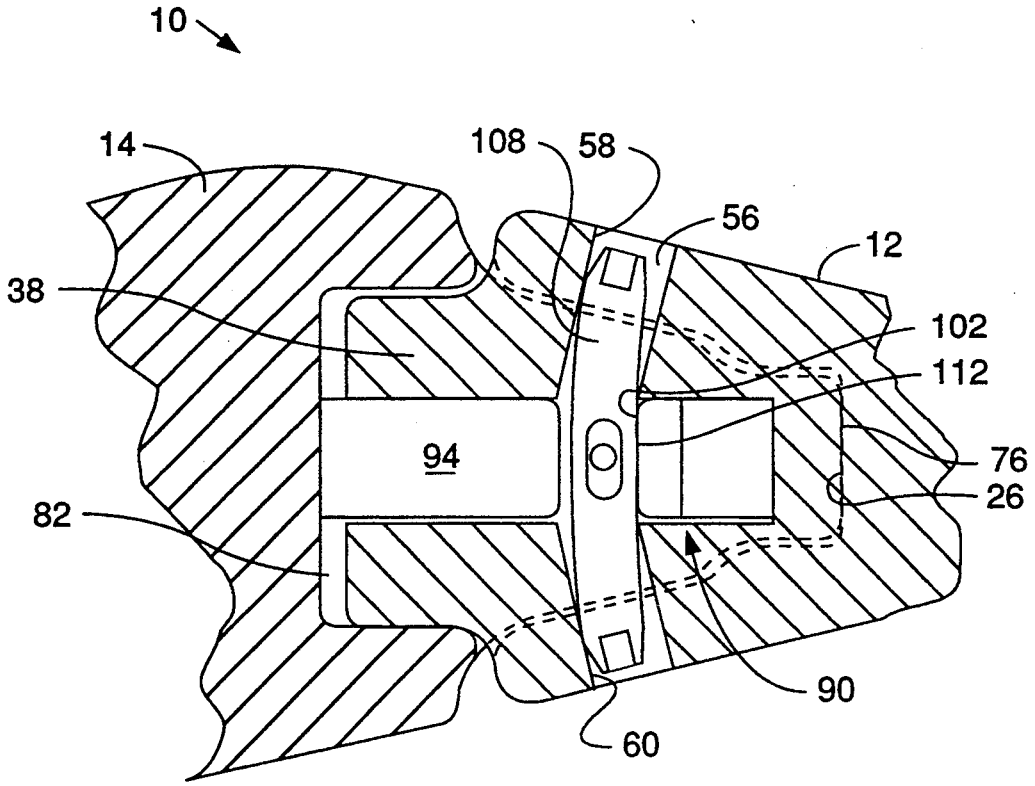
FIG. 18 is a partial cross-sectional view of the elements of FIG. 13 in their assembled condition.

As illustrated in FIG. 18 and FIG. 13, the pin 108 of the subject embodiment does not have recessed side surfaces 112 but the non-recessed side surfaces 112 of the subject embodiment is adapted, when assembled, to mate with the pin contacting surface 102 of the adapter 14. All other portions of the pin 108 of the subject embodiment are the same as that set forth in the previous embodiment.

The assembly of the tip 12, the adapter 14, and the retention mechanism 16 is the same as that previously set forth with respect to FIG. 12 of the previous embodiment. As previously explained and as illustrated in FIG. 18, the raised lugs 90 of the adapter 14 and the longitudinally extending groove 48 of the tip 12 terminate at a location spaced from the area of contact between the load bearing bottom surface 26 of the tip 12 and the generally flat end surface 76 of the adapter 14. Additionally, as previously noted, the pin 108 has straight side surfaces 112 as opposed to recessed side surfaces 112.

It is recognized that various forms of the tooth assembly could be utilized without departing from the essence of the invention. For example, the pin receiving openings 56,62 could have other cross-sectional shapes such as round or other multi-sided configurations. Additionally, the top and bottom portions 58,60,64,66 of the respective pin receiving openings 56,62 could be at various angles with respect to the longitudinally extending grooves 48,50 without departing from the essence of the invention. Likewise, the adapter 14 could be produced having only one raised lug on one side thereof and the tip could be made having only one longitudinally extending groove 48 therein for receiving the one raised lug of the adapter 14.

Industrial Applicability

In the assembly and operation of the tooth assembly 10, the biasing member 110 is placed in the transverse opening 104 followed by the cavity 24 of the tip 12 being disposed about the nose portion 70 of the adapter 16. Once the load bearing bottom surface 26 of the tip 12 contacts the generally flat end surface 76 of the adapter 14, the pin 108 is inserted into the top portion 58 of the pin receiving opening 56. Upon applying an external force to the pin 108, the pin 108 is forced to flex as it passes through the remainder of the top portion 58, through the vertically oriented slot 100 and into the bottom portion 60 of the pin receiving opening 56. As the pin 108 is being forced through the vertically oriented slot 100, the angled slot 120 of the pin 108 contacts the end member 122 of the biasing member 110 forcing the biasing member 110 back in a direction into the transverse opening 104. Once the pin 108 reaches its fully assembled position, the end member 122 drops into the recess 118 of the pin 108 and is held therein by the biasing force of the spring 124. The force of the spring 124 is effective to maintain the pin 108 in its fully assembled position as illustrated. Since the pin 108 is forced to flex due to its side surface 112 being in intimate contact at its mid point with the pin contacting surface 102 of the raised lug 90 and the intimate contact of the end portions 114 of the pin 108 with the respective top and bottom portions 58,60 of the pin receiving opening 56, the load bearing bottom surface 26 is held tightly against the generally flat end surface 76. This forced contact eliminates unwanted looseness of tile tip 12 on the adapter 14.

During operation, any forces acting directly on the front of the forward portion 18 of the tip 12 is transferred through the load bearing bottom surface 26 directly to the generally flat end surface 76 of the adapter 14. Any downward force acting on the forward portion 18 of the tip 12 is transmitted from the top one of the pair of parallel spaced apart load bearing surfaces 36 to the top one of the pair of parallel spaced apart transverse surfaces 74 of the adapter 14. The reaction force is taken by the top load bearing surface 42 of the ear 38 contacting the upper load bearing surface 86 in the recess 82 of the adapter 14. This provides a positive force transfer from the tip 12 to the adapter 14 without having a resultant force acting to move the tip 12 away from the adapter 14. Likewise, any upward force acting on the forward portion 18 of the tip 12 is transferred to the adapter 14 through the contact of the lower one of the parallel spaced apart load bearing surfaces 36 contacting the lower one of the pair of parallel spaced apart transverse surfaces 74. The reaction force is taken by the contact between the bottom load bearing surface 44 of the ear 38 and the lower load bearing surface 86 of the adapter 14. In some instances, the upward or downward reaction force in the ear 38 is either shared or totally taken by the contact between the respective ones of the vertically opposed load bearing surfaces 52 of the longitudinally extending groove 48 and the respective one of the upper and lower load transferring surfaces 96 of the adapter 14. In each situation, the loads being subjected to the tip 12 is directed to the adapter 14 without creating any resultant forces tending to cause the tip 12 to slip off of the adapter 14. Forces acting on either side of the forward portion 18 of the tip 12 is transferred from the respective sidewalls 32,34 of the tip 12 to the sides of the forward end 72 of the nose portion 70.

During the operation of the tooth assembly 10 as previously described in the different embodiments, the forces acting on the tip 12 are transmitted directly to the adapter 14 without exerting any additional loads on the pin 108. Consequently, the pin 108 is utilized solely to secure the tip 12 to the adapter 14 and to eliminate any unnecessary looseness of the tip 12 on the adapter 14.

In view of the foregoing, it is readily apparent that the structure of the present invention provides a tooth assembly 10 having an interface between the tip 12 and the adapter 14 that allows forces to be transferred from the tip 12 to the adapter 14 without producing unnecessary resultant forces trying to cause the tip 12 to slip away from the adapter 14. Likewise, the pin receiving opening 56 in the tip 12 which interrupts the longitudinally extending groove 48 therein provides a structure that mates with an adapter 14 having a raised lug 90 on one side thereof which is received in the longitudinally extending groove 48 upon assembly. Subsequent to the tip 12 being mounted on the adapter 14, a pin 108 is inserted through the pin receiving opening 56 and contacts the raised lug 90 on the adapter 14 to firmly secure the tip 12 to the adapter 14. In the subject invention, the pin receiving opening does not go through the middle of the nose portion 70 of the adapter 14.

Other aspects, objects, and advantages of this invention can be obtained through a study of the drawings, the disclosure and the appended claims.

We claim:

1. A tip adapted for use on an earthworking implement, the tip comprising:

a forward portion operative to engage the material being worked; and a rearward mounting portion operative to be secured to the earthworking implement, the rearward portion having a rearwardly opening cavity therein defined by a top wall, a bottom wall, and a pair of sidewalls and located adjacent the rearward end of the tip, an ear extending rearwardly from one sidewall of the pair of sidewalls, a longitudinally extending groove defined in the ear and the one sidewall and located on the inner side thereof adjacent the cavity, and a pin receiving opening through the tip and extending through the top wall, and the bottom wall, along the inner side of the one sidewall and opening into the longitudinally extending groove in the one sidewall.

2. The tip of claim 1 wherein a load bearing bottom surface is located at the bottom of the cavity and a pair of parallel spaced apart load bearing surfaces are located in the cavity between the pair of sidewalls and adjacent the load bearing bottom surface in the cavity.

3. The tip of claim 2 wherein the longitudinally extending groove is rectangular in cross section and has a pair of vertically opposed load bearing surfaces.

4. The tip of claim 3 wherein the pin receiving opening is rectangular in cross section.

5. The tip of claim 4 wherein the ear extending rearwardly from the one sidewall has top and bottom load bearing surfaces.

6. The tip of claim 5 wherein the pin receiving opening is perpendicular with the longitudinally extending groove.

7. The tip of claim 5 wherein the longitudinally extending groove extends to the bottom of the cavity and the vertically opposed load bearing surfaces thereof coincide with the parallel spaced apart load bearing surfaces generally adjacent the bottom of the cavity.

8. The tip of claim 7 wherein the top and bottom walls form an acute angle with an apex in the forward portion and the top portion of the pin receiving opening is perpendicular to the top wall and the bottom portion of the pin receiving opening is perpendicular to the bottom wall.

9. The tip of claim 5 wherein the longitudinally extending groove terminates short of the bottom of the cavity.

10. The tip of claim 5 including another ear extending rearwardly from the other sidewall and having other longitudinally extending groove defined in the other ear and the other sidewall and located on the side thereof adjacent the cavity.

11. The tip of claim 10 wherein the other ear extending rearwardly from the other sidewall has top and bottom load bearing surfaces.

12. The tip of claim 10 including another pin receiving opening defined in the tip extending through the top wall, the other sidewall, the bottom wall and intersecting the other longitudinally extending groove.

13. The tip of claim 12 wherein the other longitudinally extending groove is rectangular in cross section and has vertically opposed load bearing surfaces.

14. The tip of claim 13 wherein the other longitudinally extending groove extends to the bottom of the cavity and the vertically opposed load bearing surfaces thereof coincide with the parallel spaced apart load bearing surfaces generally adjacent the bottom of the cavity.

15. The tip of claim 4 in combination with an adapter having an implement mounting portion and a nose portion operatively disposed in the cavity of the tip, the nose portion has a forward end with a pair of parallel spaced apart transverse surfaces that matingly engage the parallel spaced apart load bearing surfaces in the cavity of the tip, a generally flat end surface operative to mate with the bottom surface of the cavity in the tip, and a raised lug disposed on one side of the nose portion spaced rearwardly from the pair of parallel spaced apart transverse surfaces and a retention mechanism operative to retain the tip on the adapter.

16. The combination of claim 15 wherein the raised lug extends rearwardly from the pair of parallel spaced apart transverse surface.

17. The combination of claim 16 wherein a vertically oriented slot is defined in the raised lug at a location spaced rearwardly from the spaced apart transverse surfaces and includes a pin contacting surface thereon.

18. The combination of claim 17 wherein the ear extending rearwardly from the one sidewall has top and bottom load bearing surfaces and the nose portion has a recess defined in one side thereof operative to receive the rearwardly extending ear, upper and lower load bearing surfaces are disposed in the recess on the nose portion and operative to mate with the respective top and bottom load bearing surfaces of the rearwardly extending ear.

19. The combination of claim 18 wherein at least a portion of the rearwardly extending raised lug on the adapter is disposed in the recess thereof.

20. The combination of claim 19 wherein the portion of the rearwardly extending raised lug disposed in the recess has upper and lower load transferring surfaces operative to mate with a respective one of the vertically opposed load bearing surfaces in the longitudinally extending groove in the tip.

21. The combination of claim 20 wherein the retention mechanism includes a pin disposed in the pin receiving opening and the vertically oriented slot and operative to secure the tip on the adapter.

22. The combination of claim 21 wherein a transverse opening is defined in the nose portion and extends from the vertically oriented slot through the nose portion and the retention mechanism includes a biasing member disposed in the transverse opening in force applying contact with the pin and operative to retain the pin in its assembled position.

23. An adapter for use on an earthworking implement and adapted to receive a tip thereon, the adapter comprising:

an implement mounting portion and a nose portion operative to receive the tip thereon and having a forward end with a transverse upper surface and a transverse lower surface located in a spaced apart parallel relation to said upper surface, and a generally flat end surface disposed between the transverse upper and lower surfaces, a top surface and a bottom surface extending rearwardly at an angle from a respective one of the transverse upper and lower surfaces, and a pair of raised lugs with one on each side of the nose portion and separated by the top and bottom surfaces.

24. The adapter of claim 23 wherein each raised lug of the pair of raised lugs extends rearwardly from the forward end of the nose portion.

25. The adapter of claim 24 wherein a vertically oriented slot is defined in one lug of the pair of raised lugs at a location spaced rearwardly of the forward end of the nose portion.

26. The adapter of claim 25 wherein a transverse opening is defined in the nose portion and extends from the vertically oriented slot through the nose portion.

27. The adapter of claim 25 wherein the nose portion has a pair of recesses defined therein on opposite sides thereof spaced rearwardly of the forward end of the nose portion each of the recesses having upper and lower load bearing surfaces therein.

28. The adapter of claim 27 wherein at least a portion of each of the rearwardly extending raised lugs is disposed in an respective one of the pair of recesses.

29. The adapter of claim 28 wherein the portion of the rearwardly extending raised lug disposed in an respective one of the pair of recesses has upper and lower load transferring surfaces.

* * * * *